US009699571B2

(12) United States Patent
Nielsen

(10) Patent No.: US 9,699,571 B2
(45) Date of Patent: Jul. 4, 2017

(54) HEARING AID SYSTEM ADAPTED FOR PROVIDING ENRICHED SOUND AND A METHOD OF GENERATING ENRICHED SOUND

(71) Applicant: Widex A/S, Lynge (DK)

(72) Inventor: Jakob Nielsen, Copenhagen (DK)

(73) Assignee: Widex A/S, Lynge (DK)

( * ) Notice: Subject to any disclaimer, the term of this patent is extended or adjusted under 35 U.S.C. 154(b) by 65 days.

(21) Appl. No.: 14/670,133

(22) Filed: Mar. 26, 2015

(65) Prior Publication Data

US 2015/0256948 A1 Sep. 10, 2015

Related U.S. Application Data

(63) Continuation-in-part of application No. PCT/EP2012/076581, filed on Dec. 21, 2012.

(51) Int. Cl.
*H04R 25/00* (2006.01)

(52) U.S. Cl.
CPC ..... *H04R 25/45* (2013.01); *H04R 25/353* (2013.01); *H04R 25/356* (2013.01); *H04R 25/40* (2013.01); *H04R 25/407* (2013.01); *H04R 25/502* (2013.01); *H04R 25/505* (2013.01); *H04R 25/75* (2013.01); *H04R 2225/43* (2013.01); *H04R 2430/03* (2013.01)

(58) Field of Classification Search
CPC ..... H04R 25/505; H04R 2225/43; H04R 25/353; H04R 25/356; H04R 25/40; H04R 25/407; H04R 25/502; H04R 25/45; H04R 25/75; H04R 2430/03
USPC ..... 381/320
See application file for complete search history.

(56) References Cited

U.S. PATENT DOCUMENTS

| | | | | |
|---|---|---|---|---|
| 5,403,262 | A | 4/1995 | Gooch | |
| 6,816,599 | B2 | 11/2004 | Thiede et al. | |
| 2007/0009864 | A1 | 1/2007 | Rikimaru et al. | |
| 2010/0229707 | A1 | 9/2010 | Sasaki | |
| 2012/0046713 | A1* | 2/2012 | Hannemann | H04R 25/505 607/57 |
| 2012/0308060 | A1* | 12/2012 | Pontoppidan | H04R 25/505 381/317 |
| 2016/0205481 | A1* | 7/2016 | Swanson | H03G 1/00 381/320 |

FOREIGN PATENT DOCUMENTS

| | | |
|---|---|---|
| EP | 1205904 B1 | 11/2007 |
| EP | 2132957 B1 | 11/2010 |

OTHER PUBLICATIONS

International Search Report for PCT/EP2012/076581 dated Sep. 17, 2013 with Written Opinion of the ISA.

* cited by examiner

*Primary Examiner* — Duc Nguyen
*Assistant Examiner* — Sean H Nguyen
(74) *Attorney, Agent, or Firm* — Sughrue Mion, PLLC

(57) ABSTRACT

A hearing aid (200) configured to provide enriched sound, by forming successive chords defined by a common musical scale. The invention further provides a method of providing enriched sound using a hearing aid system.

20 Claims, 3 Drawing Sheets

HEARING AID SYSTEM ADAPTED FOR PROVIDING ENRICHED SOUND AND A METHOD OF GENERATING ENRICHED SOUND

RELATED APPLICATIONS

The present application is a continuation-in-part of application PCT/EP2012076581, filed on 21 Dec. 2012, in Europe, and published as WO 2014094867 A1.

BACKGROUND OF THE INVENTION

1. Field of the Invention

The present invention relates to hearing aids. The invention more specifically relates to a hearing aid system, configured to provide enriched sound. The invention also relates to a method of generating enriched sound.

Generally a hearing aid system according to the invention is understood as meaning any device which provides an output signal that can be perceived as an acoustic signal by a user or contributes to providing such an output signal and which has means which are customized to compensate for an individual hearing loss of the user or contribute to compensating for the hearing loss of the user or contribute to compensating for the hearing loss. They are, in particular, hearing aids which can be worn on the body or by the ear, in particular on or in the ear, and can be fully or partially implanted. However, those devices whose main aim is not to compensate for a hearing loss but which have, however, measures for compensating for an individual hearing loss are also concomitantly included, for example consumer electronic devices (televisions, hi-fi systems, mobile phones, MP3 players etc.).

Within the present context a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

A traditional hearing aid system may comprise a respective hearing aid for each of the left and right ear and in that case be denoted a binaural hearing aid system. However as discussed above a hearing aid system needs not be binaural.

In the context of the present disclosure, an enriched sound should be understood as a sound having a quality whereby it is easy to relax and be relieved of e.g. stress and anxiety when subjected to it. The sounds of nature is one example of enriched sound.

2. The Prior Art

It has been suggested within the art of tinnitus alleviation to use enriched sound as a means of disguising silence, whereby the brain's attention may be diverted away from the silence and hereby away from the tinnitus. Additionally people suffering from tinnitus may benefit from enriched sound since this can lessen the perceived contrast between the tinnitus and the sound environment.

Tinnitus Retraining Theraphy (TRT) is another method that has been used to try to alleviate tinnitus. TRT methods generally use white noise provided to the tinnitus patient at a level below the tinnitus.

EP-B1-2132957 discloses a sound enrichment system for the provision of tinnitus relief, wherein a noise signal is random or pseudo-random modulated whereby the monotony of the noise signal is reduced and the resulting sound made more comfortable to listen to for many users. Random modulation of the amplitude and the frequency characteristics of the noise signal are disclosed.

One problem with this system is that despite the fact that the monotony of the noise signal is reduced, many users may still find the sounds uncomfortable to listen to. This may especially be the case for the prolonged time of use required by most TRT methods.

US-B2-6816599 discloses one type of enriched sound that can be generated by a music synthesizer in a way that is very well suited for implementation in e.g. a hearing aid.

It is a feature of the present invention to provide a hearing aid and a hearing aid system adapted to provide enriched sound with improved listening comfort.

It is another feature of the present invention to provide a method for the generation of enriched sound with improved listening comfort.

It is yet another feature of the present invention to provide enriched sound that has a broad frequency spectrum and is comfortable to listen to.

SUMMARY OF THE INVENTION

The invention, in a first aspect, provides a hearing aid system comprising an acoustical-electrical transducer adapted for converting an acoustical input sound into an electrical audio signal; a noise generator; a signal splitter configured to split the noise generator output signal in at least N parallel branches; N band-pass filters wherein each of said N branches comprises one of said N band-pass filters; level modulating means adapted to control the level of the output signal from the band-pass filters, hereby providing level modulated band-pass filter output signals and further adapted to increase the level of the output signal from one of the band-pass filters while decreasing the level of the output signal from another one of the band-pass filters; first summing means adapted to sum the level modulated band-pass filter output signals from said N branches hereby providing a sound enriched sound signal; harmonic controller means adapted to set the center frequency of the band-pass filters in accordance with a predetermined musical scale and such that at least N−1 of the band-pass filter center frequencies are selected from N−1 different predetermined frequency intervals, and adapted to change the center frequency of at least one of the band-pass filters, in response to a trigger event; timing controller means adapted to trigger the band-pass filter controlling means to change the center frequency of at least one of the band-pass filters in response to the event that the level modulating means has increased the peak level of the output signal from one of the band-pass filters to a first predetermined level, or has decreased the peak level of the output signal from one of the band-pass filters to a second predetermined level; second summing means for adding the sound enriched signal to the electrical audio signal hereby providing an electrical input signal; signal processing means configured to amplify the electrical input signal in order to alleviate a hearing loss of a hearing aid user, hereby providing an electrical output signal; and an electrical-acoustical output transducer for converting the electrical output signal into sound.

The invention, in a second aspect, provides a method of providing enriched sound comprising the steps of providing N signals with a spectral peak; selecting a musical scale; determining N−1 frequency intervals, at least partly not overlapping, selecting the spectral peak of said N signals, such that the spectral peaks belong to the same musical scale and such that the frequency of a spectral peak is selected from each of said N−1 frequency intervals; increasing the level of a first signal having a spectral peak frequency selected from the same frequency interval as a second signal while decreasing the level of said second signal; and summing said N signals, whereby a sound enriched signal comprising successive chords, defined by said spectral peak frequencies, is provided.

This provides a method for the generation of enriched sound with improved listening comfort.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the term enriched sound represents sound that is generated synthetically in order to help people feel more relaxed and comfortable, to reduce stress and to make people feel less anxious.

In one aspect the enriched sound can help to achieve this by masking unwanted and disturbing sounds. In another aspect it has been found that the enriched sound can by itself help to achieve this independent on whether the surroundings are quiet or relatively noisy.

In another aspect the enriched sound can assist in alleviating tinnitus by directing the users attention away from the tinnitus or by lowering the perceived contrast between the tinnitus and sound environment.

Figure 1:
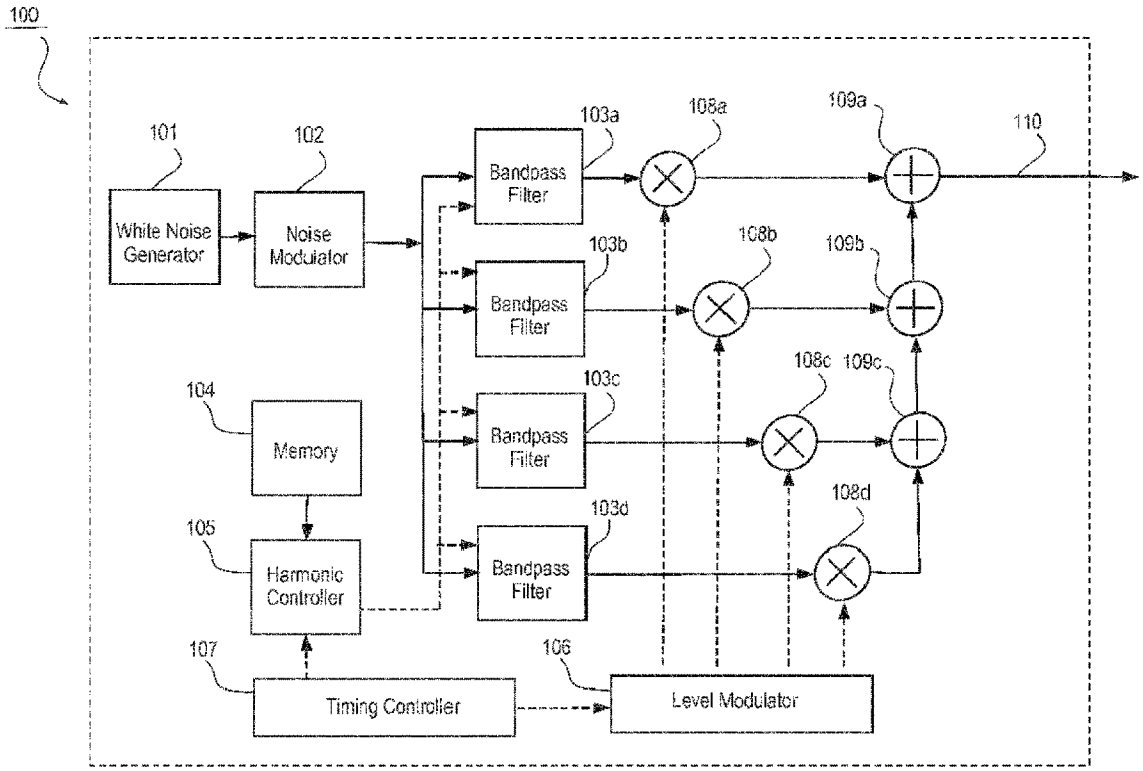
FIG. 1 illustrates highly schematically a selected part of a hearing aid system according to an embodiment of the invention.

Reference is now made to FIG. 1, which illustrates highly schematically a sound enrichment system 100 according to an embodiment of the invention. The sound enrichment system 100 comprises a white noise generator 101, a noise modulator 102, four dynamic second order band-pass filters 103*a*, 103*b*, 103*c* and 103*d*, a memory 104, a harmonic controller 105, a level modulator 106, a timing controller 107, four multiplication points 108*a*, 108*b*, 108*c* and 108*d* and three summing units 109*a*, 109*b* and 109*c*.

The white noise generator 101 provides a white noise signal that subsequently is modulated by the noise modulator 102 hereby providing a coloured noise signal. The coloured noise signal is split into four branches and in each branch the coloured noise signal is fed to one of the band-pass filters 103*a*, 103*b*, 103*c* and 103*d*.

The band-pass filters 103*a*, 103*b*, 103*c* and 103*d* are dynamic such that the center frequencies can be set by the harmonic controller 105.

The harmonic controller 105 selects the center frequencies under the restriction that a first center frequency falls within a first predetermined interval, a second center frequency falls within a second predetermined interval and the third center frequency falls within a third predetermined interval. The three intervals overlap slightly and span a range of 2 octaves, the first interval spanning the range from 55 to 220 Hz, the second interval spanning the range from 150-600 Hz and the third interval spanning the range from 400-1600 Hz. The center frequency of the fourth band-pass filter may be selected from within any of the three intervals. Further the center frequencies are selected under the restriction that they all belong to the same musical scale, this means that only center frequencies that can be expressed by the formula:

$$f = 55 \cdot \sqrt[12]{2}^{N}$$

are allowed. By only allowing center frequencies from the chromatic scale, a chord will be formed when the output from the band-pass filters are combined. The chromatic scale is the scale on which most western music is founded.

The allowed band-pass center frequencies for each of the three frequency intervals are stored in the memory 104. The band-pass center frequencies can be selected based on a deterministic algorithm or be the result of an at least partly random selection. Especially a deterministic algorithm can be designed to provide sound with a certain harmonic structure and harmonic progression.

It is a specific advantage of the present invention, that the resulting chord will be perceived as comfortable to listen to because each of the frequency intervals provides a harmonic to form the chord. The inventor has found that this is a result of the wide frequency distance between at least some of the harmonics. If the three harmonics were freely selectable and therefore allowed to be close in frequency some of the formed harmonics would be perceived as uncomfortable to listen to.

When the center frequencies are selected the level modulator 106 initiates a chord progression by gradually increasing the level of the signal from the fourth band-pass filter while decreasing the level of the signal from the band-pass filter with a center frequency selected from the same range as the center frequency of the fourth band-pass filter. The level of the signals from the band-pass filters is controlled using the level modulator 106 and the four multiplication points 108*a*, 108*b*, 108*c* and 108*d*. The dynamic range of the level variations is typically in the range between 3 and 10 dB, but may be up to 15 dB or even higher if a user has special preferences.

For hearing aid users suffering from tinnitus the dynamic range of the level variations will normally be set such that the dynamic range is comparable to the tinnitus sensation level.

According to the embodiment of FIG. 1 all the band-pass filters are second order band-pass filters, with a 3 dB bandwidth of 40 Hz. This means that the fraction of the 3 dB bandwidth relative to the width of the frequency intervals varies. In variations the 3 dB bandwidth may be in the range between 25 Hz and 500 Hz.

In variations of the embodiment of FIG. 1 the 3 dB bandwidth may be determined as a constant fraction of the corresponding frequency intervals. The fraction of the 3 dB bandwidths relative to the width of the frequency intervals can be selected from a wide range of between 2% and 50%, depending on user preference.

By selecting second order band-pass type filters a relatively broad noise background is provided while also providing a spectral peak that allows the filtered noise signal to be perceived as something resembling a tone. It is a specific advantage of this type of filters that the relatively broad noise background may render the enriched sound provided by a system according to the present invention, using these filters, suitable for use in e.g. TRT methods and in fact any other application where a broad frequency spectrum is desirable. For these applications it is normally preferred that the level of the noise background is slightly above the audible level, e.g. in the range between 2 and 6 dB above the audible level. However, the noise background needs not be audible in all hearing aid frequency bands.

The timing controller 107 controls the onset, rise and fall time for the level modulation of the output from the band-pass filters and determines when the harmonic controller 105 changes the center frequency of a band-pass filter. The timing controller 107 is adapted to trigger that a new center frequency, for a band-pass filter, is selected, by the harmonic controller 105, when the level modulator 106 has increased or decreased the gain value applied by one of the multiplication points 108*a*, 108*b*, 108*c* and 108*d* to a predetermined level. The new center frequency is selected such that it belongs to the same interval as the center frequency of one of the two band-pass filter for which the gain value applied by the multiplication point was constant in the previous cycle. The new center frequency is always selected for the band-pass filter that in the previous cycle had its level decreased to a predetermined level.

The band-pass filter with the new center frequency will be selected for having its level increased and the band-pass filter with its center frequency in the same interval as the new center frequency will be selected for having its level decreased.

According to the embodiment of FIG. 1 the rise and fall time for the level modulation are equal and preferably in the range between half a second and 10 minutes, even more preferably in the range between 10 and 30 seconds. Preferably the increase and decrease in level is logarithmic (i.e. linear in dB), hereby providing sound that will be perceived as relatively stable.

The output signals from the band-pass filters 103*a*, 103*b*, 103*c* and 103*d*, including level modulation, are summed in summing units 109*a*, 109*b* and 109*c* to provide a signal representing enriched sound 110.

It is a specific advantage of the present invention that it generally provides an enriched sound with a broad frequency spectrum, since it is based on a white noise signal. This is especially advantageous if the enriched sound is to be used in Tinnitus Retraining Theraphy (TRT).

It is a further specific advantage of the present invention, that the enriched sound is perceived as comfortable and not monotonic due to the provided chord progressions. The inventor has found that the chord progressions are less disturbing for a user when carrying out her daily tasks and therefore presumably also more efficient for alleviating e.g. tinnitus as opposed to e.g. enriched sound comprising a melodic or rhythmic structure.

According to variations of the embodiment of FIG. 1, the white noise generator 101, may be any kind of noise generator, i.e. a generator that provides pink, blue or red noise or in fact any type of coloured noise.

According to still further variations, the modulator 102 may be omitted or integrated into the white noise generator.

According to yet a further variation the noise generator may comprise a filter bank, a multi-band hearing aid compressor and a summing unit. The filter bank splits the input signal, comprising some sort of noise such as e.g. white noise, coloured noise or the noise of an acoustical-electrical transducer, into a multitude of frequency bands, the corresponding multi-band compressor applies a gain according to an expansion characteristic having an expansion ratio in the range between 1:1.5 and 1:5, and a summing unit sums the frequency bands and provides a very comfortable sound resembling running water or waves at the beach. According to a specific variation this sound can in itself be the enriched sound, whereby a very simple method and system for providing a comfortable enriched sound is provided.

According to other variations of the embodiment of FIG. 1, the memory 104 can be omitted and the allowed center frequencies be determined by an algorithm, comprised in the harmonic controller 105, capable of taking the selected scale and the predetermined frequency intervals into account.

It is another advantage of the present invention that any musical scale can be selected in order to determine the allowed center frequencies. In this way the enriched sound can be specifically adapted to a variety of geographical locations and cultures and even to the user's personal preferences.

Basically any scale can be used such as e.g.: the diatonic, chromatic, whole tone, pentatonic, octatonic, hexatonic, heptatonic, tritonic, tetratonic and microtonal scales, but also non-western scales such as e.g. the Hejaz, Pelog and Slendro scales, or the swaras of Indian music that may comprise of only five, six or seven tones and may use intervals smaller than a semitone or one of the seventy two different scales of Arabic maqam music.

Further any kind of scale tuning may be used, e.g. tempered or non-tempered scales.

According to still other variations of the embodiment of FIG. 1 two or more of the digital components comprised in the sound enrichment system 100 may be integrated in a single or a multitude of digital signal processors.

In a variation of the embodiment of FIG. 1 the band-pass filters are configured such that the combined output from the band-pass filters covers the audible spectrum. In another variation the band-pass filters are configured such that the bandwidth of the combined output from the band-pass filters exceeds the audible spectrum and therefore allows the band-pass filters to overlap in the spectral domain.

In a specifically advantageous variation the predetermined frequency ranges, wherefrom the band-pass center frequencies are selected, together span a range with a lower limit between 40 and 100 Hz and an upper limit between 1000 and 2000 Hz. The inventor has discovered that band-pass center frequencies outside this range are not suitable for providing chords that are perceived as comfortable to listen to.

However, according to yet other variations of the present invention any filter type having a shape similar to the second order band-pass filter can be used, or in fact any suitable filter.

The band-pass filters may be implemented as Finite Impulse Response (FIR), Infinite Impulse Response (IIR) or basically any other type. Especially it may be considered to use a comb type filter, whereby both the center frequency and some of the harmonics can be output from each of the branches.

In yet another variation of the embodiment of FIG. 1, each of the center frequencies is selected from its own predetermined frequency interval. Hereby chords formed by four harmonics may be provided. According to these variations a smooth transition between two chords is ensured by gradually increasing the level of the signal from e.g. the first band-pass filter 103*a* and simultaneously decreasing the level of the signal from e.g. the second band-pass filter 103*b*. In order to enjoy the contribution from all four harmonics the level of the signal from either of the band-pass filters is preferably always above the audible level.

In still other variations of the embodiment of FIG. 1, the provided chords may consist of basically any number of harmonic frequencies, although practical implementation considerations, such as the available number of band-pass filters, will limit the number of harmonic frequencies in the chords.

Thus according to some embodiments the number of band-pass filters is one larger than the number of predetermined frequency intervals. According to other embodiments the number of band-pass filters equals the number of predetermined frequency intervals. If the number of band-pass filters is larger than four, it may especially be attractive to let the number of predetermined frequency intervals be the same.

Figure 2:
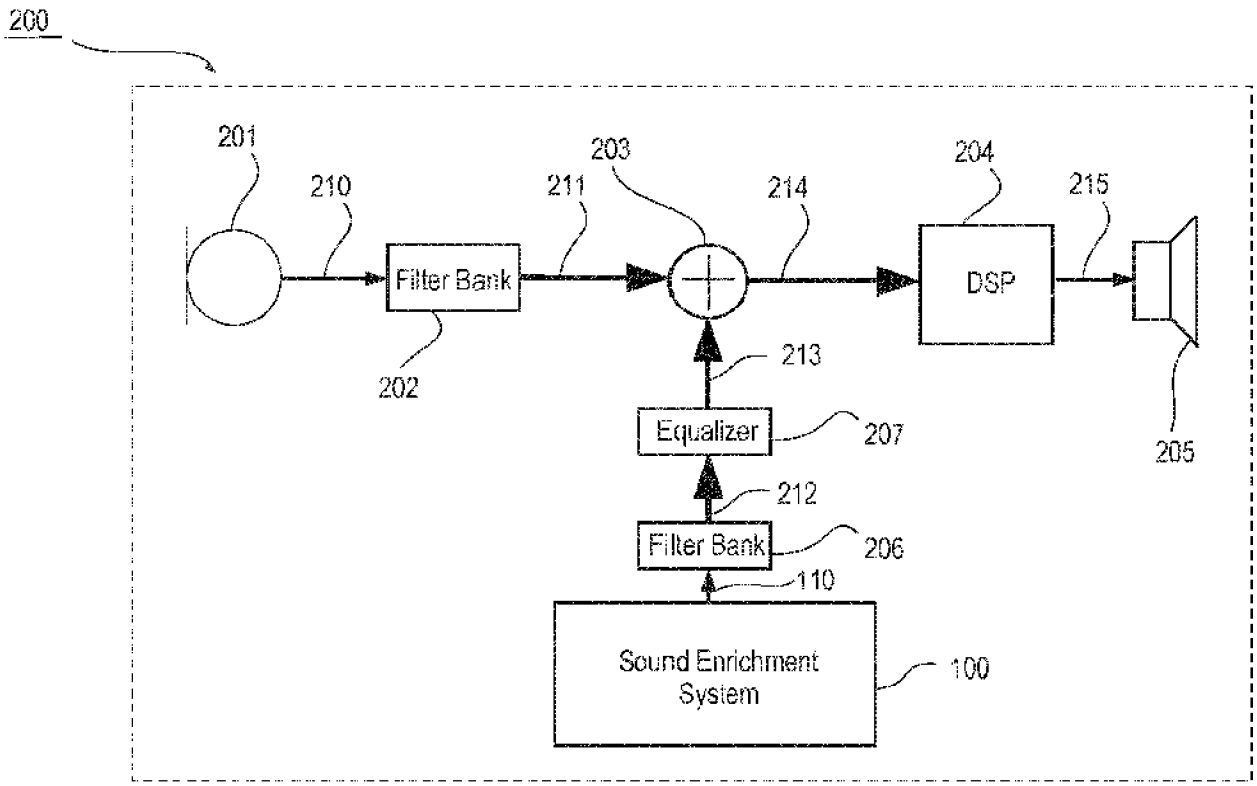
FIG. 2 illustrates highly schematically a hearing aid according to an embodiment of the invention.

Reference is now made to FIG. 2 that highly schematically illustrates a hearing aid 200 according to an embodiment of the invention.

The hearing aid 200 comprises an acoustical-electrical transducer 201, a first filter bank 202, a summing unit 203, a digital signal processor 204, an electrical-acoustical transducer 205, the sound enrichment system 100, a second filter bank 206 and an equalizer 207.

The acoustical-electrical transducer 201 transforms an acoustic signal from the surroundings into an electrical audio signal 210, which is provided to the first filter bank 202, which splits the electrical audio signal 210 into a multitude of hearing aid frequency bands, that in FIG. 2 are illustrated by a single bolder signal line 211, which are provided to a first input of the summing unit 203.

The sound enrichment system 100 provides that an electrical signal representing the enriched sound 110 is provided to the second filter bank 206, which splits the electrical audio signal representing the enriched sound 110 into a multitude of hearing aid frequency bands, that in FIG. 2 are illustrated by a single bolder signal line 212, which are provided to the equalizer 206 that applies a gain to each of the frequency bands such that the level of the noise background provided by the enriched sound is a few dB higher than the audible limit, preferably in the range of 0.5 to 5 dB above the audible limit. The output from the equalizer 207 provides a signal 213, that represents equalized enriched sound, and is provided to a second input of the summing unit 203, whereby the summing unit 203 provides a sum signal 214 that is the sum of the electrical signal representing the equalized enriched sound 213 and the band-pass filtered electrical audio signal 211.

The sum signal 214 is provided to an input of the signal processor 204 for further standard hearing aid signal processing adapted for alleviating a hearing deficit of the hearing aid user. Finally the signal processor 204 provides an electrical output signal 215 to the electrical-acoustical transducer 205 for converting the electrical output signal 215 into sound.

Figure 3:
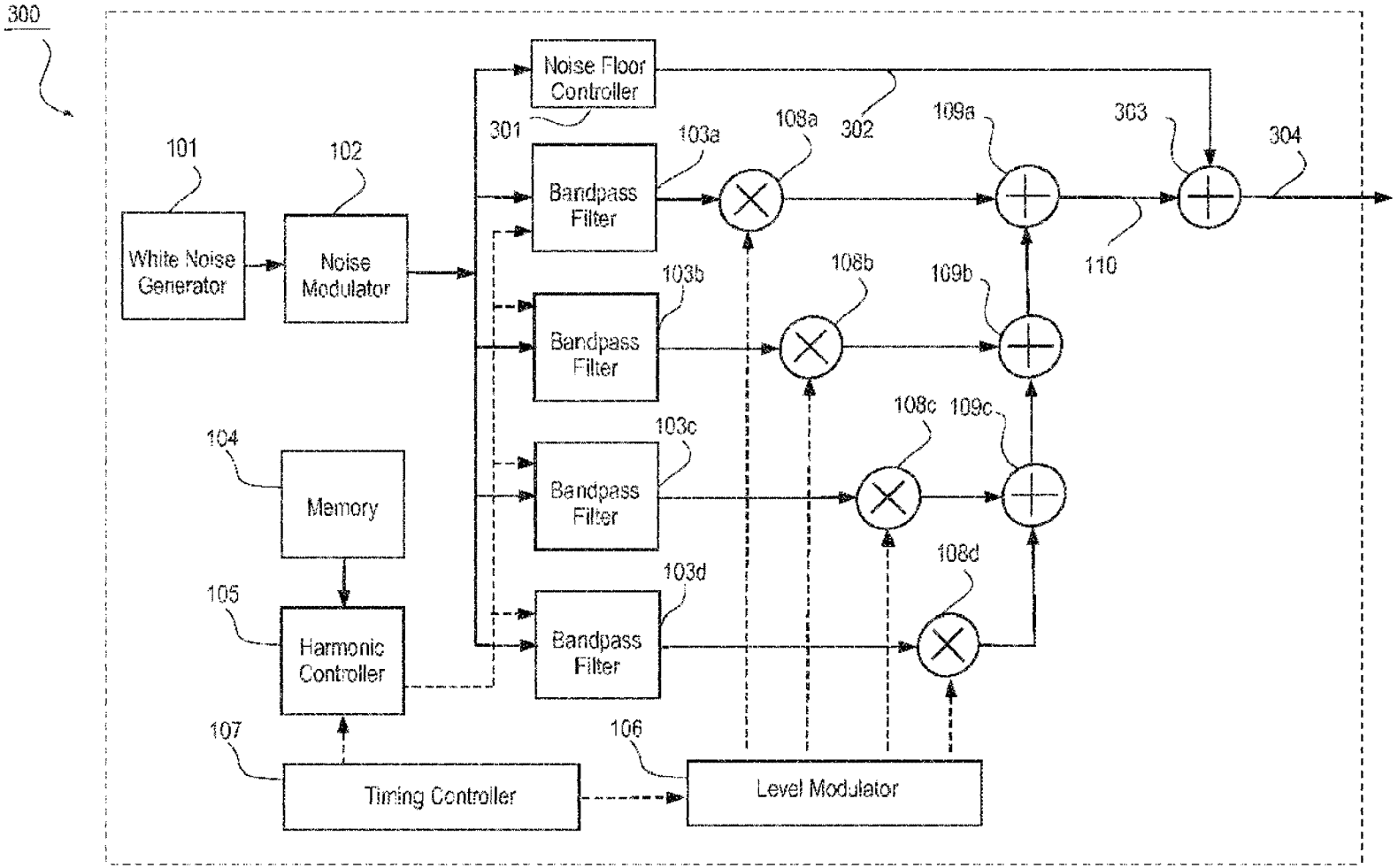
FIG. 3 illustrates highly schematically a selected part of a hearing aid system according to an embodiment of the invention.

Reference is now made to FIG. 3, which illustrates highly schematically a sound enrichment system 300 according to an embodiment of the invention. The sound enrichment system 300 is identical to the sound enrichment system 100 of FIG. 1, except that the coloured noise signal is split into five branches instead of four branches, and that the fifth branch comprises a noise background controller 301, that applies a gain to the coloured noise signal hereby providing a level adjusted noise signal 302. The level adjusted noise signal 302 is added to the electrical signal representing the enriched sound 110 in summing unit 303 hereby providing an electrical signal 304 representing enriched sound wherein the noise background level is freely adjustable. This embodiment is specifically advantageous in that the level of the spectral peak of the output signals from the band-pass filters 103*a-d* relative to the level of the noise background given by the level adjusted noise signal 302 is freely adjustable. This provides a significant relaxation of the requirements to the filter design, since the band-pass filters according to this embodiment can be selected e.g. purely based on the spectral width of the band-pass filter peak and thus need not take the desired level of the noise background of the enriched sound into account.

Especially when coloured noise is used to provide the enriched sound, the noise background can't be defined as a specific number, but it will readily within the capability of a person skilled in the art to provide a reasonable estimate of the noise background, also in this case.

All the variations of the embodiments of FIG. 1 and FIG. 2 may also be applied in connection with the embodiment of FIG. 3.

According to yet other variations, the enriched sound is provided based on sound that is not necessarily based on a noise signal. In one embodiment the spectral peaks used to form the chords are provided by a set of parallel music synthesizers, such as e.g. disclosed in EP-B1-1205904.

I claim:

1. A hearing aid system comprising an acoustical-electrical transducer adapted for converting an acoustical input sound into an electrical audio signal;

a noise generator;

a signal splitter configured to split a noise generator output signal in at least N parallel branches;

N band-pass filters wherein each of said N branches comprises one of said N band-pass filters;

a level modulator adapted to control a level of the output signal from the band-pass filters, hereby providing level modulated band-pass filter output signals and further adapted to increase the level of the output signal from one of the band-pass filters while decreasing the level of the output signal from another one of the band-pass filters;

a first summer adapted to sum the level modulated band-pass filter output signals from said N branches hereby providing a sound enriched sound signal;

a harmonic controller adapted to set a center frequency of the band-pass filters in accordance with a predetermined musical scale and such that at least N−1 of the band-pass filter center frequencies are selected from N−1 different predetermined frequency intervals, and adapted to change the center frequency of at least one of the band-pass filters, in response to a trigger event;

a timing controller adapted to trigger the harmonic controller means to change the center frequency of at least one of the band-pass filters in response to the event that the level modulator has increased a peak level of the output signal from one of the band-pass filters to a first predetermined level, or has decreased the peak level of the output signal from one of the band-pass filters to a second predetermined level;

a second summer for adding the sound enriched signal to the electrical audio signal hereby providing an electrical input signal;

a signal processor configured to amplify the electrical input signal in order to alleviate a hearing loss of a hearing aid user, hereby providing an electrical output signal; and an electrical-acoustical output transducer for converting the electrical output signal into sound.

2. The hearing aid system according to claim 1, wherein said musical scale is selected from a group of musical scales comprising: diatonic, chromatic, whole tone, pentatonic, octatonic, hexatonic, heptatonic, tritonic, tetratonic and microtonal scales.

3. The hearing aid system according to claim 1, wherein said level modulator is adapted to increase the peak level of the output from a first of said band-pass filters from said second predetermined level and to said first predetermined level and to simultaneously decrease the peak level of the output from a second of said band-pass filters from said first level and to said second level.

4. The hearing aid system according to claim 3, wherein said level modulator is adapted to provide that the output from a band-pass filter can progress between said first predetermined level and said second predetermined level within a duration in the range of 10 seconds to 300 seconds.

5. The hearing aid system according to claim 3, wherein said level modulator is adapted to provide that the difference in peak level between said first predetermined level and said second predetermined level is in the range of 3 dB to 15 dB.

6. The hearing aid system according to claim 1, wherein the signal splitter is configured to split the noise generator output signal in four parallel branches and wherein three of the band-pass filter center frequencies are selected from three different predetermined frequency intervals.

7. The hearing aid system according to claim 1, wherein said predetermined frequency intervals each spans a range of between 1 octave and 3 octaves.

8. The hearing aid system according to claim 1, wherein said predetermined frequency intervals at least partly do not overlap.

9. The hearing aid system according to claim 1, wherein said predetermined frequency intervals overlaps and wherein the width of the overlaps is in range between 50 Hz and 500 Hz.

10. The hearing aid system according to claim 1, wherein said predetermined frequency intervals span a frequency range with a lower limit between 40 Hz and 100 Hz and an upper limit between 1000 Hz and 5000 Hz.

11. The hearing aid system according to claim 1, comprising an equalizer filter bank adapted for splitting the sound enriched signal into a multitude of hearing aid frequency bands and an equalizer adapted for amplifying each of said multitude of hearing aid frequency bands such that the level of the noise background of the sound enriched signal is in the range of 2 dB to 6 dB above the audible level.

12. The hearing aid system according to claim 1, wherein said noise generator comprises a multi-band compressor adapted to perform an expansion in the range of 1:1.5.and 1:5.

13. The hearing aid system according to claim 1, wherein said signal splitter splits the signal in N+1 branches, and wherein one of said N+1 branches comprises a noise background controller adapted to provide a noise background with a predetermined level relative to the peak level of the output signal from one of the band-pass filters.

14. A method of providing enriched sound comprising the steps of:

generating N electrical audio signals by a noise generator, each of said N signals having a spectral peak;

selecting a musical scale;

determining N−1 frequency intervals, at least partly not overlapping, selecting the spectral peak of each of said N signals, such that each of the spectral peaks belong to the same musical scale and such that the frequency of a spectral peak is selected from each of said N−1 frequency intervals;

increasing a level of a first signal having a spectral peak frequency selected from the same frequency interval as the peak frequency of a second signal while decreasing the level of said second signal;

summing said N signals, whereby a sound enriched signal comprising successive chords, defined by said spectral peak frequencies, is provided; and generating said enriched sound by an output transducer responsive to said sound enriched signal.

15. The method according to claim 14, wherein said step of generating N signals with a spectral peak comprises the steps of:

providing a noise signal;

splitting said noise signal in N parallel branches; and providing a band-pass filter in N of said branches;

said step of selecting the spectral peak comprises the steps of:

selecting the center frequency of said N band-pass filters, such that the center frequencies belong to said same musical scale and such that a center frequency is selected from each of said N−1 frequency intervals; and said step of summing said N signals comprises the steps of:

summing the output from said parallel branches, whereby a sound enriched signal comprising successive chords, defined by said band-pass center frequencies, is provided.

16. The method according to claim 14, wherein said frequency intervals together span a frequency range with a lower limit between 40 Hz and 100 Hz and an upper limit between 1000 Hz and 2000 Hz.

17. The method according to claim 14, wherein said spectral peak has a 3 dB bandwidth of less than 500 Hz.

18. The method according to claim 14, wherein said spectral peak has a 3 dB bandwidth of less than 200 Hz.

19. The method according to any one of the claim 14, comprising the further step of adding a signal with a predetermined noise background level to the sound enriched signal.

20. A non-transitory computer readable medium carrying instructions which, when executed by a computer, cause the method according to claim 14 to be performed.

* * * * *